US006550576B1

(12) United States Patent
Meller

(10) Patent No.: US 6,550,576 B1
(45) Date of Patent: Apr. 22, 2003

(54) METHOD AND APPARATUS FOR RESCUING OCCUPANTS FROM HIGH RISE BUILDING USING REPLACEABLE CABLE CARTRIDGES AND DYNAMIC RESISTANCE DEVICE

(76) Inventor: Moshe Meller, Apt. 1505
111-Yefe-Nof, Haifa (IL), 34454

( * ) Notice: Subject to any disclaimer, the term of this patent is extended or adjusted under 35 U.S.C. 154(b) by 22 days.

(21) Appl. No.: 10/011,913

(22) Filed: Nov. 6, 2001

Related U.S. Application Data

(60) Provisional application No. 60/329,390, filed on Oct. 15, 2001, provisional application No. 60/329,935, filed on Oct. 16, 2001, and provisional application No. 60/385,886, filed on Oct. 16, 2001.

(51) Int. Cl.[7] ..... A62B 1/06; A62B 1/08; A62B 1/20; B65H 23/04

(52) U.S. Cl. ..... 182/73; 182/193; 182/231; 242/396.9

(58) Field of Search ..... 182/193, 191, 182/5, 192, 234, 70, 230, 231, 73; 248/208; 188/187–189, 65.1, 65.2, 65.3, 65.4, 180, 185; 254/389–391, 405, 160, 157, 158, 159; 242/396.5, 396.9, 423, 423.1

(56) References Cited

U.S. PATENT DOCUMENTS

| | | | | | |
|---|---|---|---|---|---|
| 309,141 | A | | 12/1884 | Good | |
| 319,888 | A | | 6/1885 | Dittrick | |
| 1,490,524 | A | | 4/1924 | Wood | |
| 3,035,665 | A | * | 5/1962 | Gauley | 188/184 X |
| 3,602,483 | A | * | 8/1971 | Russell et al. | 188/184 X |
| 3,844,377 | A | * | 10/1974 | Wilkins | 182/73 X |
| 3,861,496 | A | | 1/1975 | Hoover | |
| 3,900,081 | A | * | 8/1975 | Dunston | 182/73 |
| 3,946,989 | A | * | 3/1976 | Tsuda | 182/5 X |
| 4,000,881 | A | * | 1/1977 | Matsumoto | 188/184 X |
| 4,029,298 | A | * | 6/1977 | Lassche | 254/158 |
| 4,469,196 | A | | 9/1984 | Sadler | |
| 4,640,388 | A | * | 2/1987 | Walborn | 182/231 |
| 4,722,422 | A | * | 2/1988 | Hiraoka | 182/233 |
| 4,949,812 | A | * | 8/1990 | Arthur et al. | 182/234 |
| 5,483,849 | A | * | 1/1996 | Orii et al. | 188/184 X |
| 5,913,383 | A | | 6/1999 | Tseng | |
| 6,328,129 | B1 | * | 12/2001 | Ferguson | 182/70 |

OTHER PUBLICATIONS

Rotary Vane Air Compressor, Model 6066 Series, manufactured by GAST Manufacturing Inc., Benton Harbor, MI 49022, Air Compressors Catalog 1998, p. 3. No month available.

Regenerative Blower, Regenair® R7 Series, Model R7 100A–2, manufactured by GAST Manufacturing Inc., Benton Harbor, MI 49022, Air Compressors Catalog 1998, pp. 109 and 127. No month available.

* cited by examiner

*Primary Examiner*—Daniel P. Stodola
*Assistant Examiner*—Hugh B. Thompson
(74) *Attorney, Agent, or Firm*—Frishauf, Holtz, Goodman & Chick, P.C.

(57) ABSTRACT

A rescue method and apparatus for rescuing occupants from high rise buildings includes a frame adjacent an escape portion of the building; a dynamic resistance device mounted to the frame; and a removable and replaceable cable cartridge, having a pre-roller cable, which is removably and non-rotatably coupled to a rotatable portion of the dynamic resistance device. The cable is connectable to a person to be rescued. When the person to be rescued goes out from the escape portion of the building, his falling motion causes the cable to move with the same speed as the falling speed, thus causing the rotatable portion of the dynamic resistance device to rotate and to create resistance to the falling speed, until the falling speed of the person reaches a substantially constant value. After a first person is rescued, a new cable cartridge is mounted and the cable thereof is connected to a next person to be rescued.

34 Claims, 3 Drawing Sheets

METHOD AND APPARATUS FOR RESCUING OCCUPANTS FROM HIGH RISE BUILDING USING REPLACEABLE CABLE CARTRIDGES AND DYNAMIC RESISTANCE DEVICE

This application claims the benefit of U.S. Provisional Application Nos. 60/329,390 filed Oct. 15, 2001; 60/329,935 filed Oct. 16, 2001; and 60/385,886 filed Oct. 26, 2001, the entire contents of which are incorporated herein by reference.

BACKGROUND OF THE INVENTION

This invention relates to a rescue method and apparatus for rescuing occupants from high rise buildings, which is highly reliable, always ready to be used, with no preparation, which can rescue many people within a short time, for example, at a time of a fire, and which requires no power supply.

The problem of rescuing trapped people from high rise buildings at the time of a fire, explosion, etc., is well-known and has been reemphasized tragically by the events of Sep. 11, 2001. Most of the known rescue systems, such as emergency stairs or fire fighter ladders, cannot be used in the event of major fires, because the flights of emergency stairwells will catch fire first, and fire fighter ladders are not high enough and cannot cross the fire zone.

Various systems are known for rescuing occupants from high-rise buildings. One such system, disclosed in U.S. Pat. No. 3,198,880, utilizes a fan mechanism to which a cable is connected. However, this system requires rewinding of the cable after each escape. This is time consuming and impractical when being used for evacuating a large number of people from a high-rise building.

Another system using a fan is disclosed in U.S. Pat. No. 4,469,196. This system dispenses the cable only once, and has no provisions for renewing the cable.

Another single-use device is disclosed in U.S. Pat. No. 3,861,496. This system is relatively complex and does not provide for multiple use and therefore cannot rescue many people from a high-rise building within a short period of time.

OBJECTS OF THE INVENTION

An object of the present invention is to provide a reliable, simple to operate, rescue system that will save many people's lives at the time of major fires or other disasters.

Another object of the invention is to provide such a rescue system which can rescue a large number of people from a high-rise building in a relatively short period of time.

Still another object of the invention is to provide such a rescue system having replaceable cable cartridges which are relatively inexpensive and which can be quickly changed after a person has been rescued, at a high repetition rate.

Yet another object of the invention is to provide such a rescue system which will enable crossing of a fire zone, especially in high-rise buildings.

Still another object of the invention is to provide such a rescue system which takes up little space, and which is economical to manufacture, install and maintain.

SUMMARY OF THE INVENTION

A rescue system according to the present invention comprises a frame which is preferably connected to the floor or other structure of a building, near an escape portion of the building, which escape portion is open or can be easily opened or broken at the time of a fire or other emergency situation that requires evacuation of occupants from the building; and a fan having a shaft and at least two vanes connected to the shaft. The shaft is rotatably connected to the frame so that fan rotates freely relative to the frame. The shaft coupled to the fan has a connecting portion which removably and non-rotationally connects to a replaceable cable cartridge. The cable cartridge comprises a spool with a coupling portion which mates with the connecting portion of the shaft so as to removably engage the shaft and rotate together with the shaft. That is, the shaft and the spool are interconnected with each other so that they are non-rotatable relative to each other and so that the spool is easily removable after use. A rolled cable (preferably a steel cable of about 3 mm diameter and having a length of at least the height of the building) is wound on the spool which is removably engagable with the connecting portion of the shaft. A rescue belt or harness (such as used in rock climbing, parachuting or the like, for example) is removably connected to the free end of the rolled cable.

At the time of a fire or other emergency, the persons to be rescued wear the rescue belt or harness, a first cable cartridge is engaged on the connecting portion of the shaft and the free end of the cable is hooked or otherwise engaged with the rescue belt or harness. The first person jumps or slides out from the escape portion of the building, and the falling person causes the fan to rotate (via the spool and shaft). The falling speed of the person is limited by the resistance of the rotating fan. The maximum falling speed can be limited to, for example, about 8 m/sec. (which is about equal to the free falling speed from a height of about 3.2 meters). Higher or lower falling speeds can be achieved and used by, for example, appropriately adjusting the fan blades, the size and number of the fan blades and the diameter of the spool of the cable cartridge.

When the first rescued person reaches the ground, the cable becomes loose and the spent cable cartridge can be removed from the shaft (by pulling same up, for example) and the spent spool can be replaced by a new one. The second person's rescue belt or harness is hooked to the free end of the cable of the new cable cartridge and he/she jumps or slides out from the escape portion of the building. This process is repeated until the last person is rescued.

The fan (dynamic resistance device) can be replaced by other dynamic resistance devices, and/or a transmission can couple the rotation of the spool of the cable cartridge thereto.

DETAILED DESCRIPTION

Figure 1:
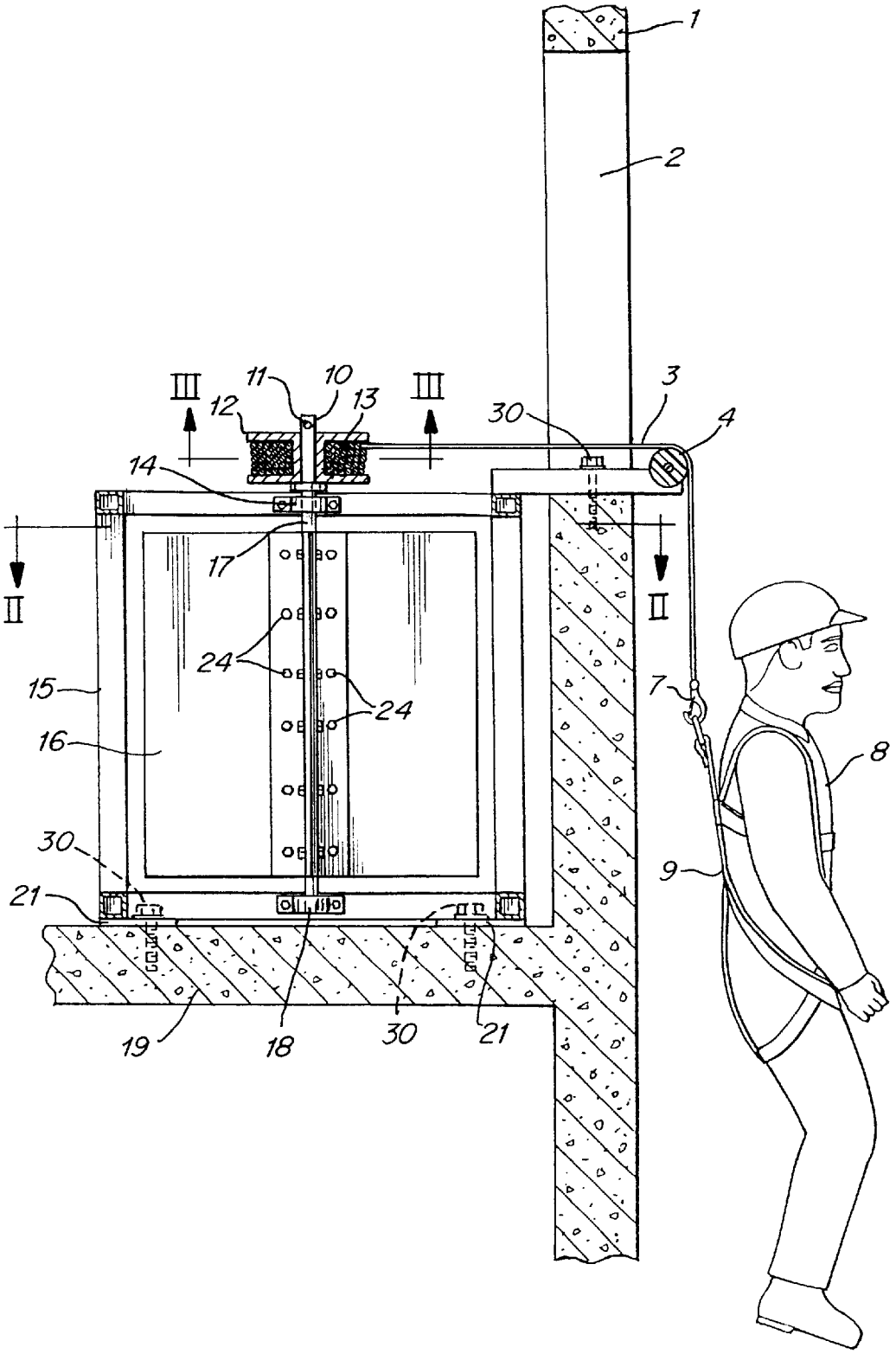
FIG. 1 is a sectional view of a rescue system according to the present invention taken along line I—I in FIG. 2, with additional elements and a person being shown in FIG. 1.
Figure 2:
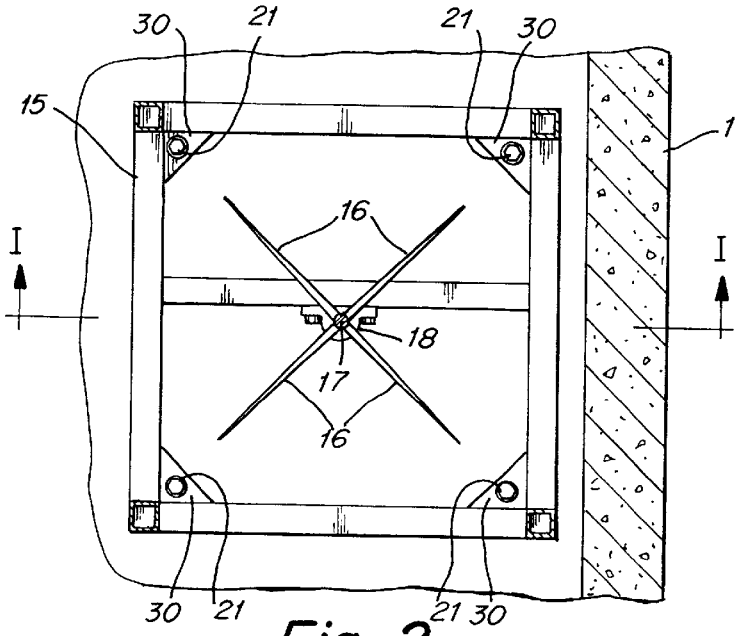
FIG. 2 is a sectional view thereof, taken along line II—II in FIG. 1.
Figure 3:
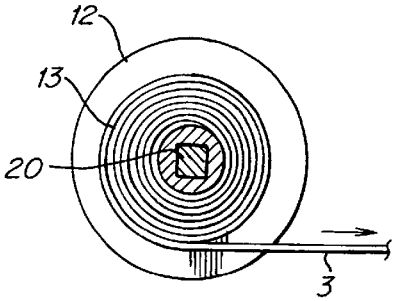
FIG. 3 is a sectional view of the cable cartridge, taken along line III—III in FIG. 1.

Referring to FIGS. 1 and 2, the rescue system of the present invention comprises a main frame 15, preferably made of steel or stainless steel, preferably from profiled steel members such as hollow square □ steel members. The frame elements of frame 15 can be welded together. The main frame 15 is shown as rectangular in shape. Other shapes could be used. The main frame 15 is positioned on the floor 19 against the building's wall 1 near a window 2 that can be opened or broken to the outside at the time of a fire or other emergency requiring evacuation of the building. The main frame 15 is preferably fixed to a building structure such as the floor of the building or a building wall using concrete screws 30 and connecting plates 21 or by other anchoring members. An air fan (dynamic resistance device) comprises air fan blades 16 coupled to a fan shaft 17 which is mounted to the main frame 15 through an upper bearing 14 and a lower bearing 18. The air fan has at least two fan blades 15 and preferably has four blades 16 as shown in FIG. 2. The fan can have three blades or any other desired number. The blades can be connected to the fan shaft by screws or pins or rivets 24 (see FIG. 5) or the like.

Figure 6:
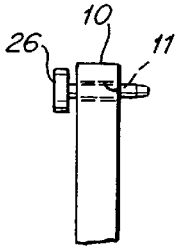
FIG. 6 shows the upper end of the fan shaft with a safety pin inserted therein.

The bearings 18 and 14 are preferably ball bearings and provide a free rotational motion to the fan. The upper end 10 of the fan shaft 17 extends out from the upper level of the main frame 15. This extending section 10 of the fan shaft 17 preferably has a square or rectangular shape and has a hole 11 therethrough to be used to receive a removable safety pin 26, as shown in FIG. 6.

In a typical example, the general dimensions of the main frame of a rescue system of the present invention are preferably about: 100 cm wide×100 cm long×100 cm high.

The preferred dimensions of each fan blade are about 90 cm high×50 cm wide so that the total active area of a 4 blades air fan is: $90\times50\times4=18{,}000\ cm^2=1.8\ m^2$. The upper end 10 of the air fan shaft 17 is non-round, i.e., in the shape of a square or rectangle, to provide removable non-rotatable engagement between said shaft 17 and the cable cartridge 12. Other non-round shapes as hexagonal, triangle, oval or any other irregular mating shapes are possible.

Figure 4:
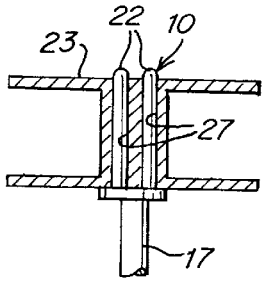
FIG. 4 is a detailed sectional view of another possible connection between the cable cartridge and the air fan shaft of the present invention.

FIG. 4 shows another type of engagement system between the upper portion 10 of the air fan's shaft and the cable cartridge 12 in which two or more pins 22 extend upwardly from the upper end of shaft 17 and engage into respective holes 27 in the cartridge spool 23. The two pins 22 extend from the upper end 10 of the air fan's shaft 17. The cable cartridge 23 has two holes 27, that receive the respective pins 22, which provides the removable and non-rotatable engagement between the cable cartridge 23 and the air fan's shaft 17. Any other type of removable connection which prevents the cartridge from rotating relative to the shaft 17 of the fan can be used.

Figure 7:
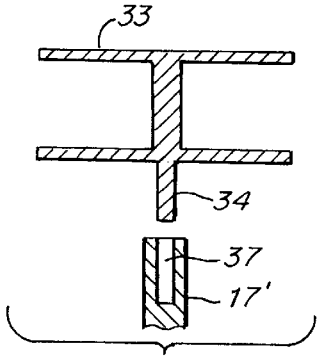
FIG. 7 shows another interconnection between the fan shaft and the removable cartridge.

Other connection techniques for connecting the cable cartridge to the fan shaft can be used. For example, as shown in FIG. 7, the cartridge 33 (which is similar to the other cartridges disclosed herein) has a shaft portion 34 extending therefrom, which is non-round (for example square, rectangular, etc.). The fan shaft 17' (similar to the fan shaft 17 described hereinabove) has a mating opening 37 at the upper end thereof which removably receives the projecting portion 34 of the cartridge 33 in a non-rotatable manner. That is, projecting portion 34 mates with receptacle 37 so as to provide a non-rotational coupling between shaft 17' and cartridge 33. In still another embodiment, member 34 of FIG. 7 could be round (or any other shape) and opening 37 could be round (or any other shape), and a pin (such as pin 26 of FIG. 6) could be provided which projects laterally through the upper end of the shaft 17' and through the member 34 so as to lock members 34 and 17' together in a non-rotational manner. To remove the cartridge after use, the pin must be pulled out, a new cartridge must then be installed and the pin must be replaced. This technique is more complex and may slow down the operation of replacing used cartridges.

Figure 5:
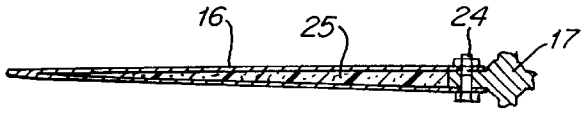
FIG. 5 is a detailed sectional view of an air fan blade of the present invention.

FIG. 5 shows in detail a possible construction of an air fan blade 16 and its connection to the air fan shaft 17. The fan blade 16 outer surface is preferably made from steel (or other metal) sheets. A plastic filling 25, which can be a strong plastic material such as polyurethane material or the like is filled between the steel (or other metal) sheets. Pins, screws or rivets 24 provide the connection between the blade 16 and the projecting connection members of the air fan shaft 17.

FIG. 1 shows the cable cartridge 12 engaged to the square end 10 of the air fan shaft 17. The rolled cable 13 is wound on the cable cartridge housing 12. The cable 13 is preferably made from steel wire, preferably about 3 mm in diameter. Other materials (such as nylon) and other diameters can be used, so long as the cable has sufficient strength to safely support a person. The cable 13 is connected at one end to the cartridge housing 12, while the other free end is connected to a safety hook 7, such as the type that is used in rock climbing, parachuting or the like.

At the time of a rescue operation, after the cable cartridge 12 is engaged with the shaft 11, the hook 7 is connected to the rescue belt or harness 9 of the person 8, and then the cable is put out over a guiding roller 4 (connected to the main frame 15 or to the building) and the person to be rescued goes out from the window. The free end of the cable, if desired, can be pre-connected directly to a belt or harness 9.

When the rescued person 8 starts to fall downwardly, his motion causes the cable 13 to move at the same speed and thus causes the cable cartridge spool to rotate accordingly (depending upon its diameter) in order to provide the needed linear dispensing speed to the cable 13. The rotation of the cable cartridge spool causes the air fan to rotate. In the embodiment of FIG. 1, the rotation speed of the air fan is the same as that of the cable spool, and the linear speed of the air fan blades is higher than the linear speed of the dispensing cable.

The following equation can be used to calculate these speeds:

$$\frac{Vblade}{Vcable}=\frac{Rblade}{Rcable}$$

where:

Vcable—is the linear speed of the downwardly falling rescued person

Vblade—is the linear speed of the outer (peripheral part of the fan blade).

Rcartridge—is the radius of the rolled cable 13 in the cartridge housing 12.

Rblade—is the radius to the outer part of the fan blade.

$$Vblade = \frac{Rblade}{Rcable} \times Vcable$$

if the ratio $$\frac{Rblade}{RCable} = 6$$

then Vblade=6×Vcable.

If the falling speed of the person is 8 meters/sec.=Vcable, then Vblade=6×8=48 meters/second.

At this speed level (Vblade about 48 meters/second), the air fan provides enough resistance to keep the falling speed substantially constant (i.e., an equilibrium condition where the resistance force created by the air fan is equal to the force of gravity acting on the falling person).

At this falling person speed of about 8 m/sec, the rescued person can land on the ground safely. A lower or higher speed, can be used. When the first rescued person has landed on the ground, the cable becomes loose (slack) and the cable cartridge 12 can be replaced by a new cable cartridge, and next person is then connected to the cable of the new cable cartridge and is then rescued. This process is repeated until all persons are rescued. Of course, a suitable number (at least as many as the number of people at risk and which should be evacuated) of new cable cartridges are provided and preferably stored in close proximity to the main frame 15 for quick and easy access in an emergency situation.

A typical example for the rescuing rate is as follows:

H=height of the Building=200 meters.

Vcable=falling speed of person=8 m/sec.

TRep.=Time to replace a new cable cartridge=5 sec.

Tconn.=Time to connect the rescued person=5 sec.

The time ($T_N$) to rescue 20 people (N=20) will be:

$$T_N = N\left(\frac{H}{Vcable} + TRep. + TConn.\right) =$$

$$T_{20} = 20\left(\frac{200}{8} + 5 + 5\right) = 700 \text{ sec.} = 11.66 \text{ min.}$$

20 people can be rescued within less than 12 minutes.

Figure 8:
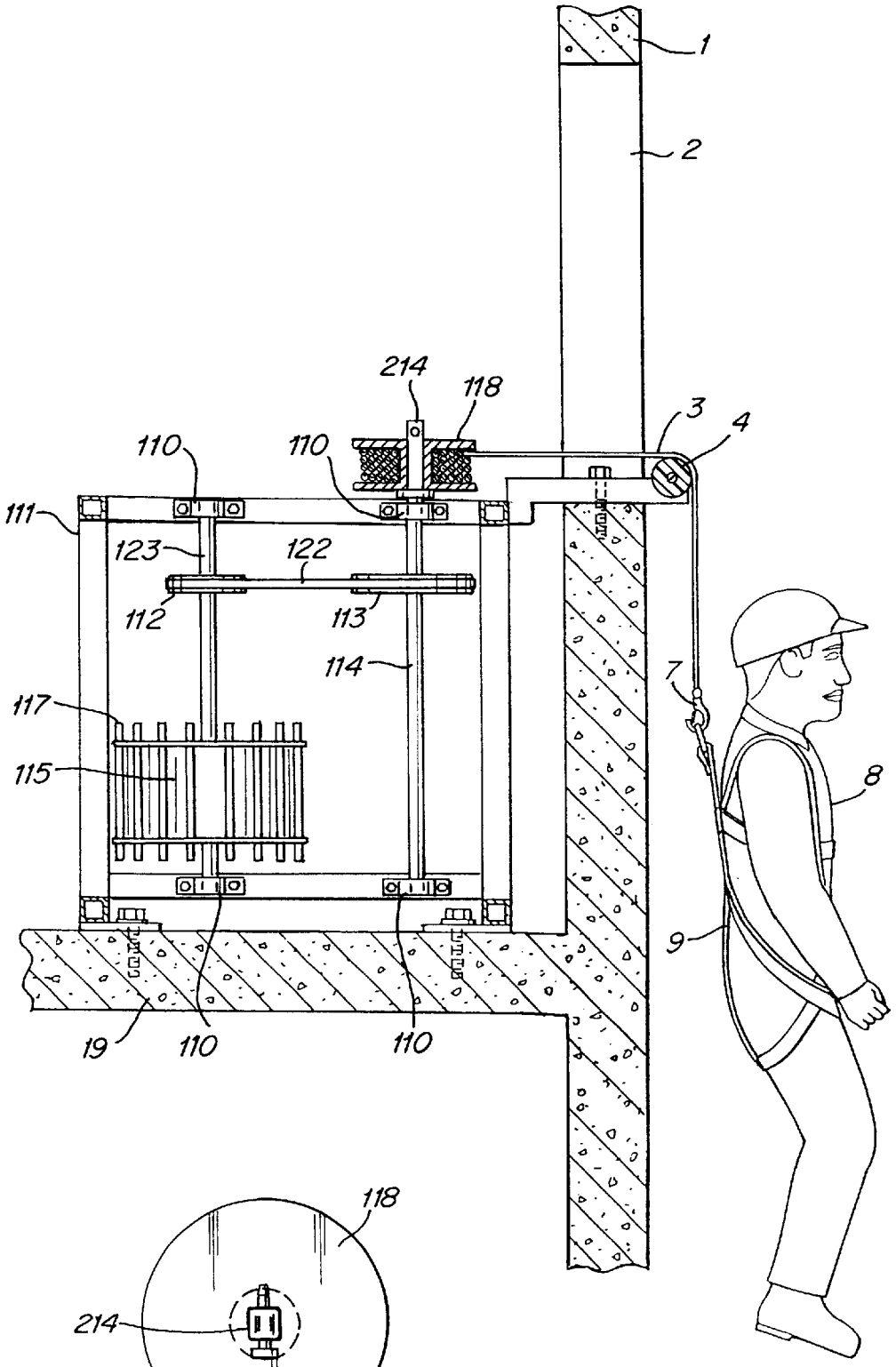
FIG. 8 is a sectional view, similar to FIG. 1, showing another embodiment of the invention.
Figure 9:
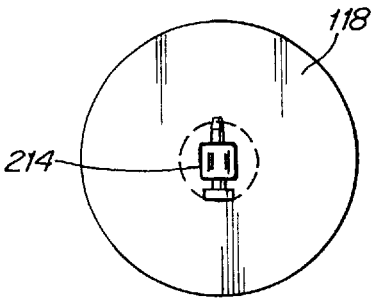
FIG. 9 is a top view showing the engagement between the shaft and the cable spool.

According to a second embodiment of the invention shown in FIGS. 8 and 9, rotatable fan 16 is replaced by a mechanism including a dynamic resistance mechanism 115 which can be an oil pump, centrifugal brake system, a water pump, an electric generator, air blower or the like. The dynamic resistance mechanism 115 provides a resistance to rotation which is a function of its rotational speed. That is, the higher the rotation speed, the higher will be the resistance to rotation of the dynamic resistance mechanism. The construction of an apparatus using a dynamic resistance is described below.

Referring to FIG. 8, shaft 114 is connected to the frame 111 through bearings 110 (preferably ball bearings) which allow the shaft 114 to rotate relative to the frame 111. One end 214 of the shaft 114 has a shape which allows the cable cartridge 118 to be removably engaged so that the spool of the cable cartridge 118 is non-rotatable relative to the shaft 114. The shape of the end 214 of the shaft 114 is preferably square or rectangular but any other shape or form (such as hexagonal, triangular, etc.) which allows removable engagement between end 214 and cartridge 118, can be used. The opening of the cable cartridge has a mating shape to provide the non-rotational engagement. The safety pin arrangement of FIG. 6 can be used with the embodiment of FIGS. 8 and 9.

The shaft 114 is connected to the dynamic resistance device 115 through a transmission 112, 113, 122. The transmission 112, 113, 122 can be made of gears, belt-and-pulleys (as shown in FIG. 8), or the like. The belt-and-pulley arrangement of FIG. 8 comprises pulleys 112, 113 connected together by a belt 122. The transmission 112, 113, 122 preferably has a drive ratio which increases the rotational speed of the dynamic resistance device 115 relative to shaft 114. A large heat sink 117 is attached to dynamic resistance device 115 to provide cooling to the dynamic resistance device 115 so as to prevent overheating.

A typical cooling rate which is needed from the heat sink 117 is mgv, where m=mass of the rescued person (for example, about 100 Kg), g=9.8 (gravity), and v=falling speed of rescued person=8 m/sec.

$$mgv = 100 \text{ kg} \times 9.8 \times 8 \text{ m/sec.} = 7{,}840 \text{ watts} = 7.84 \text{ kw.}$$

At the time of fire or other emergency evacuation from the building, the person 7 to be rescued wears the rescue belt 9, the cable cartridge 118 is engaged to the shaft 114, and the cable hook 5 is hooked to the rescue belt 9. The first person jumps or slides out of the window, his falling causes the cartridge 118 and the shaft 114 to rotate, the transmission 112, 113, 122 causes the dynamic resistance device 115 to rotate, and the falling speed is limited by the resistance of the dynamic resistance device 115. The limited falling speed can be about 8 meters/sec, as in the first example above, but higher or lower speeds can be achieved and used.

When the first person lands on the ground the cable 3 becomes loose or slack and the cable cartridge 118 can be replaced and the next person can be hooked to the new cable 3 and rescued. This process will be repeated until the last person will be rescued.

While the invention has been described above with respect to a vertical shaft position (of shafts 17, 114), other shaft positions such as horizontal or any other desired position or orientation can be used. Moreover, instead of a direct drive between the cable cartridge 12 and the fan shaft 17, as shown in FIG. 1, the fan of FIG. 1 can be mounted as the dynamic resistance device 115 as shown in FIG. 8 and a gear transmission or belt-and-pulley transmission can be used (as shown in FIG. 8) between the cable cartridge 12 and the rotatable fan shaft 17.

The dynamic resistance device 115 of FIG. 8 can be a fan such as shown in FIG. 1, coupled to transmission 112, 113, 122, or can take various other forms. For example, the dynamic resistance device 115 can be a rotary vane compressor, such as the oilless rotary vane compressor Model 6066 Series manufactured by Gast Manufacturing Corporation, Benton Harbor, Mich. 49022. Alternatively, a regenerative blower such as REGENAIR® R7 Series, also manufactured by Gast Air Compressors, can be used. If the R7 Series REGENAIR® device is used, a drive motor therefor is not needed, since the drive shaft of the REGENAIR® R7 Series blower will be coupled to the shaft 123 of FIG. 8 to provide the desired rotation and the air resistance. Other dynamic resistance devices, such as those shown in U.S. Pat. No. 3,198,880, U.S. Pat. No. 4,469,196 and U.S. Pat. No. 3,861,496, for example, can be used as the dynamic resistance device 115 of the present invention. The critical factor in the present invention is the removable cartridge configuration to enable quick and easy replacement of the cartridge after each rescue operation so that a large number of people can be rescued in a relatively short period of time and at a relatively low cost.

While the apparatus is shown and described as being used adjacent a window of a building, such as a high-rise building, the apparatus can be used adjacent to a door of a building opening to the outside, or any other opening of a building which enables escape of occupants to the outside of the building. Special openings, or even special break-away wall portions can be used instead of windows. Alternatively, the apparatus can be mounted on a roof or veranda (terrace) of a building.

While the invention has been described above with respect to specific structures, various alterations, modifications and substitutions can be made within the scope of the appended claims.

What is claimed is:

1. A rescue system for rescuing occupants from high floors in high rise buildings, comprising:

a frame positioned adjacent an open or openable escape portion of a building, the escape portion being open or openable to the outside of the building;

an air fan having a shaft and at least two vanes coupled to the shaft, the shaft being mounted to said frame such that said fan is rotatable relative to said frame; and a removable and replaceable cable cartridge comprising a rotatable housing which is removably coupled to said air fan so as to rotate said air fan upon rotation of said rotatable housing, and said cable cartridge having a cable pre-rolled on said rotatable housing, said cable having a free end which is connectable to a person to be rescued;

wherein when the person to be rescued goes out from the escape portion of the building, a failing motion of the person causes the cable to move with the same speed as the speed of falling of the person, thus causing said rotatable housing to rotate which in turn causes the air fan to rotate and to create air resistance to the falling speed, until the falling speed of the person reaches a substantially equilibrium value when the resistance force created by the air fan is equal to the force of gravity acting on the falling person.

2. The rescue system according to claim 1, wherein said cable has another end which is connected to said rotatable housing.

3. The rescue system, according to claim 1, wherein said frame is fixed to a building structure.

4. The rescue system according to claim 3, wherein said frame is fixed to the building by one of screws, bolts or pins.

5. The rescue system according to claim 1, wherein said cable cartridge and said air fan have respective mutually engagable members which mate so as to prevent relative rotation therebetween.

6. The rescue system according to claim 5, wherein said mutually engagable members are in the form of a square, a hexagonal or a triangular shape.

7. The rescue system according to claim 1, wherein said rotatable housing of said cable cartridge and a shaft portion coupled to said air fan have mutually engagable members which mate so as to prevent relative rotation therebetween.

8. The rescue system according to claim 1, wherein one of said rotatable housing of said cable cartridge and a shaft portion coupled to said air fan has at least two pins extending therefrom, and the other of said rotatable housing of said cable cartridge and the shaft coupled to the air fan has holes for receiving the respective pins.

9. The rescue system according to claim 1, further comprising a safety coupling device coupled to at least one of said cable cartridge and the shaft portion coupled to said air fan to secure the non-rotatable connection between the cable cartridge and said shaft portion.

10. The rescue system according to claim 1, further comprising a cable guiding roller arranged on a portion of the building to guide said cable to the outside of the building.

11. The rescue system according claim 1, further comprising a belt or harness coupled to the person being rescued, and which is connectable to the free end of said cable.

12. The rescue system according claim 1, wherein said fan blades are dimensional such that the maximum falling speed of the person being rescued is less than about 12 meters per second and more than about 4 meters per second.

13. The rescue system according claim 1, wherein said fan blades are dimensional such that the maximum falling speed of the person being rescued is about 8 meters per second.

14. The rescue system according to claim 1, wherein the materials of said frame, air fan and cable cartridge are fire proof and can perform with no failure in temperatures up to about 600° C.

15. A rescue system for rescuing occupants from high floors in high rise buildings, comprising:

a frame positioned adjacent an open or openable escape portion of a building, the escape portion being open or openable to the outside of the building;

dynamic resistance means for creating a resistance to a gravity force acting on a person to be rescued, said dynamic resistance means having a shaft coupled thereto, said shaft being mounted to said frame such that said shaft is rotatable relative to said frame to drive said dynamic resistance means; and a removable and replaceable cable cartridge comprising a rotatable housing which is removably coupled to said dynamic resistance means so as to rotate said dynamic resistance means upon rotation of said rotatable housing, and said cable cartridge having a cable pre-rolled on said rotatable housing, said cable having a free end which is connectable to the person to be rescued;

wherein when the person to be rescued goes out from the escape portion of the building, a falling motion of the person causes the cable to move with the same speed as the speed of falling of the person, thus causing said rotatable housing to rotate which in turn causes said dynamic resistance means to rotate and to create a resistance to the falling speed, until the falling speed of the person reaches a substantially equilibrium value when the resistance force created by said dynamic resistance means is equal to the force of gravity acting on the falling person.

16. The rescue system according to claim 15, wherein said cable has another end which is connected to said rotatable housing.

17. The rescue system according to claim 15, wherein said frame is fixed to a building structure.

18. The rescue system according to claim 17, wherein said frame is fixed to the building by one of screws, bolts or pins.

19. The rescue system according to claim 15, wherein said cable cartridge and said dynamic resistance means have respective mutually engagable members which mate so as to prevent relative rotation therebetween.

20. The rescue system according to claim 19, wherein said mutually engagable members are in the form of a square, a hexagonal or a triangular shape.

21. The rescue system according to claim 15, wherein said rotatable housing of said cable cartridge and a shaft portion coupled to said dynamic resistance means have mutually engagable members which mate so as to prevent relative rotation therebetween.

22. The rescue system according to claim 15, wherein one of the cable cartridge and a shaft portion coupled to said dynamic resistance means has at least two pins extending therefrom, and the other of said rotatable housing of said cable cartridge and said shaft portion coupled to said dynamic resistance means has holes for receiving the respective pins.

23. The rescue system according to claim 15, further comprising a safety coupling device coupled to at least one of said cable cartridge and said shaft portion coupled to said dynamic resistance means to secure the non-rotatable connection between the cable cartridge and said shaft portion.

24. The rescue system according to claim 15, further comprising a cable guiding roller arranged on a portion of the building to guide said cable to the outside of the building.

25. The rescue system according claim 15, further comprising a belt or harness coupled to the person being rescued, and which is connectable to the free end of said cable.

26. The rescue system according claim 15, wherein said dynamic resistance means provides a resistance such that the maximum falling speed of the person being rescued is less than about 12 meters per second and more than about 4 meters per second.

27. The rescue system according claim 15, wherein said dynamic resistance means provides a resistance such that the maximum falling speed of the person being rescued is about 8 meters per second.

28. The rescue system according to claim 15, wherein the materials of said frame, dynamic resistance means and cable cartridge are fire proof and can perform with no failure in temperatures up to about 600° C.

29. A method of rescuing occupants from high floors in high rise buildings using an apparatus, comprising:

a frame positioned adjacent an open or openable escape portion of a building, which escape portion is open or openable to the outside of the building; and a dynamic resistance device having a rotatable shaft;

the method comprising:

(a) providing a plurality of removable and replaceable cable cartridges, each comprising a rotatable housing which has a cable pre-rolled on said rotatable housing, said cable having a free end which is connectable to an occupant to be rescued;

(b) removably coupling said cable cartridge to said rotatable shaft of said dynamic resistance device so as to rotate a portion of said dynamic resistance device upon rotation of said rotatable housing;

(c) connecting said free end of said cable to the occupant to be rescued;

(d) causing the occupant to be rescued to go out from the escape portion of the building, whereby a failing motion of the occupant to be rescued causes the cable to unwind from the cartridge and to move with the same speed as the speed of falling of the occupant to be rescued, thus causing said rotatable housing to rotate which in turn causes said portion of said dynamic resistance device to rotate and to create a resistance to the falling speed, unlike the failing speed of the occupant to be rescued reaches a substantially equilibrium value when the resistance force created by said dynamic resistance device is equal to the force of gravity acting on the falling occupant to be rescued;

(e) removing the unwound cable cartridge and removably coupling a new cable cartridge to said dynamic resistance device; and repeating steps (b)–(e) to successively rescue additional occupants.

30. The rescue method according to claim 29, wherein said cable cartridge and said dynamic resistance device have respective mutually engagable members which mate so as to prevent relative rotation therebetween.

31. The rescue method according claim 29, wherein said step of connecting said free end of said cable to the occupant to be rescued comprises placing a belt or harness on the occupant to be rescued, and then connecting said free end of said cable to said belt or harness.

32. The rescue method according claim 29, wherein said dynamic resistance device is arranged to provide a resistance such that the maximum falling speed of the occupant being rescued is less than about 12 meters per second and more than about 4 meters per second.

33. The rescue method according claim 29, wherein said dynamic resistance device is arranged to provide a resistance such that the maximum falling speed of the occupant being rescued is about 8 meters per second.

34. The rescue method according to claim 29, comprising fabricating said frame, dynamic resistance device and cable cartridge from fire proof materials which can perform with no failure in temperatures up to about 600° C.

* * * * *